US009726041B2

(12) United States Patent
Almstedt et al.

(10) Patent No.: US 9,726,041 B2
(45) Date of Patent: Aug. 8, 2017

(54) DISABLING CIRCUIT IN STEAM TURBINES FOR SHUTTING OFF SATURATED STEAM

(75) Inventors: Henning Almstedt, Mülheim an der Ruhr (DE); Peter Dumstorff, Bochum (DE); Martin Kuhn, Neuss (DE); Thomas Müller, Heiligenhaus (DE); Rudolf Pötter, Essen (DE); Norbert Thamm, Essen (DE); Uwe Zander, Mülheim an der Ruhr (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 770 days.

(21) Appl. No.: 13/823,143

(22) PCT Filed: Sep. 14, 2011

(86) PCT No.: PCT/EP2011/065909

§ 371 (c)(1),
(2), (4) Date: Mar. 14, 2013

(87) PCT Pub. No.: WO2012/035047

PCT Pub. Date: Mar. 22, 2012

(65) Prior Publication Data

US 2013/0170956 A1 Jul. 4, 2013

(30) Foreign Application Priority Data

Sep. 16, 2010 (EP) ..... 10177090

(51) Int. Cl.
*F01D 25/24* (2006.01)
*F01D 25/00* (2006.01)
(Continued)

(52) U.S. Cl.
CPC ..... *F01D 25/24* (2013.01); *F01D 3/04* (2013.01); *F01D 25/007* (2013.01); *F01D 3/02* (2013.01);
(Continued)

(58) Field of Classification Search
CPC . F01D 3/04; F01D 3/02; F01D 25/007; F05D 2260/95; F05D 2260/60;
(Continued)

(56) References Cited

U.S. PATENT DOCUMENTS 1,344,193 A * 6/1920 Wilson ..... F01D 3/04 415/106
2,326,112 A 8/1943 Zetterquist
(Continued)

FOREIGN PATENT DOCUMENTS

CN 1370254 A 9/2002
EP 1035301 A1 9/2000
(Continued)

*Primary Examiner* — Alexander Comley

(57) ABSTRACT

A cooling option for a steam turbine is provided, wherein the steam turbine includes a high-pressure zone and a medium-pressure zone, wherein the saturated steam streaming out of the high-pressure zone is discharged via a saturated steam conduit to a first pressure chamber in a second flow channel of the medium-pressure zone and thus the possibility of the saturated steam causing damage by corrosion and erosion in the high-pressure zone is prevented.

9 Claims, 2 Drawing Sheets

(51) Int. Cl.
*F01D 3/04* (2006.01)
*F01D 3/02* (2006.01)

(52) U.S. Cl.
CPC .... *F05D 2220/31* (2013.01); *F05D 2260/608* (2013.01); *F05D 2260/95* (2013.01)

(58) Field of Classification Search
CPC .. F05D 2260/602; F05D 2260/605–2260/606; F05D 2260/608
USPC ..... 415/106, 107, 104
See application file for complete search history.

(56) References Cited

U.S. PATENT DOCUMENTS

| | | | | |
|---|---|---|---|---|
| 2,920,867 | A * | 1/1960 | Reese | F01K 7/22 415/103 |
| 6,305,901 | B1 * | 10/2001 | Bell | F01D 1/16 415/100 |
| 6,695,575 | B1 | 2/2004 | Sasse | |
| 2008/0213085 | A1 * | 9/2008 | Deidewig | F01D 3/04 415/104 |

FOREIGN PATENT DOCUMENTS

| | | | |
|---|---|---|---|
| EP | 1624155 | A1 | 2/2006 |
| EP | 1806476 | A1 | 7/2007 |
| EP | 2154332 | A1 | 2/2010 |

* cited by examiner

DISABLING CIRCUIT IN STEAM TURBINES FOR SHUTTING OFF SATURATED STEAM

CROSS REFERENCE TO RELATED APPLICATIONS

This application is the US National Stage of International Application No. PCT/EP2011/065909, filed Sep. 14, 2011 and claims the benefit thereof. The International Application claims the benefits of European Patent office application No. 10177090.7 EP filed Sep. 16, 2010. All of the applications are incorporated by reference herein in their entirety.

FIELD OF INVENTION

The invention relates to a steam turbine comprising a rotatably mounted rotor, an inner casing and a high-pressure flow duct arranged between the rotor and the inner casing, wherein the rotor has a dummy piston, wherein the steam turbine has a dummy piston line, wherein the dummy piston line opens into a dummy piston prechamber.

BACKGROUND OF INVENTION

For thermodynamic reasons, steam turbines are used at relatively high temperatures. Recent development in modern turbomachine construction has tended toward planning for temperatures of over 700° C., and even over 720° C., in the inflow zone of a high-pressure turbine section. Such high temperatures lead to special thermal stresses on the materials used.

Steam turbines are conventionally divided into a plurality of turbine sections, e.g. a high-pressure, medium-pressure and low-pressure turbine section. The abovementioned turbine sections differ essentially in that the steam parameters, such as the temperature and pressure of the inflowing steam, are different. Thus, a high-pressure turbine section is exposed to the highest steam parameters and is thus subjected to the most severe thermal stress. The steam flowing out of the high-pressure turbine section is reheated by means of an intermediate superheater and flows into a medium-pressure turbine section, with the steam flowing into the low-pressure turbine section without intermediate superheating after flowing through the medium-pressure turbine section.

In general, the turbine sections are constructed separately, i.e. each turbine section comprises a separate casing. However, there are also known designs in which the high-pressure turbine section and the medium-pressure turbine section are accommodated in a common outer casing. Equally well known are turbine sections in which the medium-pressure component and the low-pressure component are arranged jointly in one outer casing.

Particularly in the high-pressure and the medium-pressure zone, the turbine sections are constructed with a rotor, an inner casing arranged around the rotor, and an outer casing. The rotor comprises rotor blades, which form a flow duct with the guide blades arranged in the inner casing. In general, the high-pressure turbine sections are of single-flow design, leading to a relatively high thrust due to the steam pressure on the rotor in one direction. The rotors are therefore generally constructed with dummy pistons. By admitting a flow to the dummy piston at a defined point, a pressure is produced, leading to a counterthrust which holds the rotor in the axial direction in a manner substantially free from forces.

The high temperatures require the use of materials which can withstand the high temperatures and pressures. Steels based on a nickel base or high-percentage chromium steels are also suitable for use at high temperatures.

In addition to the high temperatures, the components of a steam turbine must be of relatively corrosion-resistant design since many components are exposed to a flow of wet steam and, at the same time, the flow velocity of the steam is high. Given an encounter with wet steam in conjunction with a high flow velocity, such components would develop corrosion and erosion. This problem is currently eliminated by taking relatively expensive measures. One of said measures would be the use of high-chromium materials, for example, or the use of coatings which are applied to the components and thus avoid corrosion and erosion.

Particularly in the case of high-pressure turbine sections, the steam flowing out of the flow duct, which is essentially a wet steam, i.e. small water particles have formed in the steam, flows on components in the steam turbine, leading to damage, e.g. corrosion or erosion of the component. One known way of keeping this wet steam away from the components is to use protective shields.

SUMMARY OF INVENTION

The invention has set itself the object of avoiding corrosion and erosion damage caused by wet steam.

The object is achieved by a steam turbine comprising a rotatably mounted rotor, an inner casing and a first flow duct arranged between the rotor and the inner casing, wherein the rotor has a dummy piston, wherein the steam turbine has a dummy piston steam line, wherein the dummy piston steam line opens into a dummy piston prechamber, wherein the steam turbine has a wet steam line, which establishes a fluidic connection between a gap space and a first pressure space, wherein the gap space is arranged between the rotor and the inner casing. The turbine has a second flow duct, wherein the dummy piston steam line is connected fluidically to the second inflow zone or to some other pressure space. Thus, a steam, which can be a superheated steam, can pass out of the second flow duct, via the dummy piston steam line, into the dummy piston prechamber.

By means of the dummy piston steam line, steam is introduced into a dummy piston prechamber, which, owing to the pressure, exerts a force on the rotor in order to compensate for a thrust. The dummy piston is generally part of the rotor, ideally having a radius specifically chosen for the desired thrust compensation at an axial point of appropriate pressure level. The prechamber is situated ahead of a radial circumferential surface. The dummy piston steam line is connected to a steam source which has a defined steam with a pressure and a temperature. This steam mixes with the steam flowing out of the high-pressure turbine section and passes between the dummy piston and the inner casing and into an intermediate space between the inner casing and the outer casing. At the point where the steam flows out between the rotor and the inner casing, the outer casing is subjected to severe stress in terms of erosion and corrosion. According to the invention, the steam turbine is now embodied with a wet steam line. This wet steam line opens into a gap space which is situated between the inner casing and the rotor. At this point, the wet steam flowing out of the flow duct of the high-pressure turbine section flows in the direction of the dummy piston. This wet steam line is connected fluidically to a first pressure space, wherein the pressure prevailing in said first pressure space is lower than in the gap space. This has the effect that the wet steam in said gap space is as it were almost completely extracted and discharged in the wet steam line. The mixing of the wet steam with the steam in the dummy piston prechamber is thereby drastically reduced. Outflow of a mixed steam formed from the wet steam and the steam in the dummy piston prechamber is thereby virtually prevented, with the result that virtually no mixed steam flows between the dummy piston and the inner casing and against the outer casing. The outer casing can therefore be produced from a material which has a relatively low corrosion and erosion resistance. This will lead to a more advantageous version of the outer casing.

Advantageous developments are indicated in the dependent claims.

In a particularly advantageous development, the first pressure space is arranged in the second flow duct, wherein the first pressure space has a pressure which is lower than the pressure in the gap space. This has the effect that the wet steam from the high-pressure turbine section which has entered the gap space flows via the wet steam line into the first pressure space. Thus, the unwanted wet steam is extracted and discharged into the second flow duct before it can even reach the outer casing.

BRIEF DESCRIPTION OF THE DRAWINGS

The invention is now described in greater detail with reference to an illustrative embodiment. The components with the same reference signs operate in essentially the same way.

In the drawing.

DETAILED DESCRIPTION OF INVENTION

Figure 1:
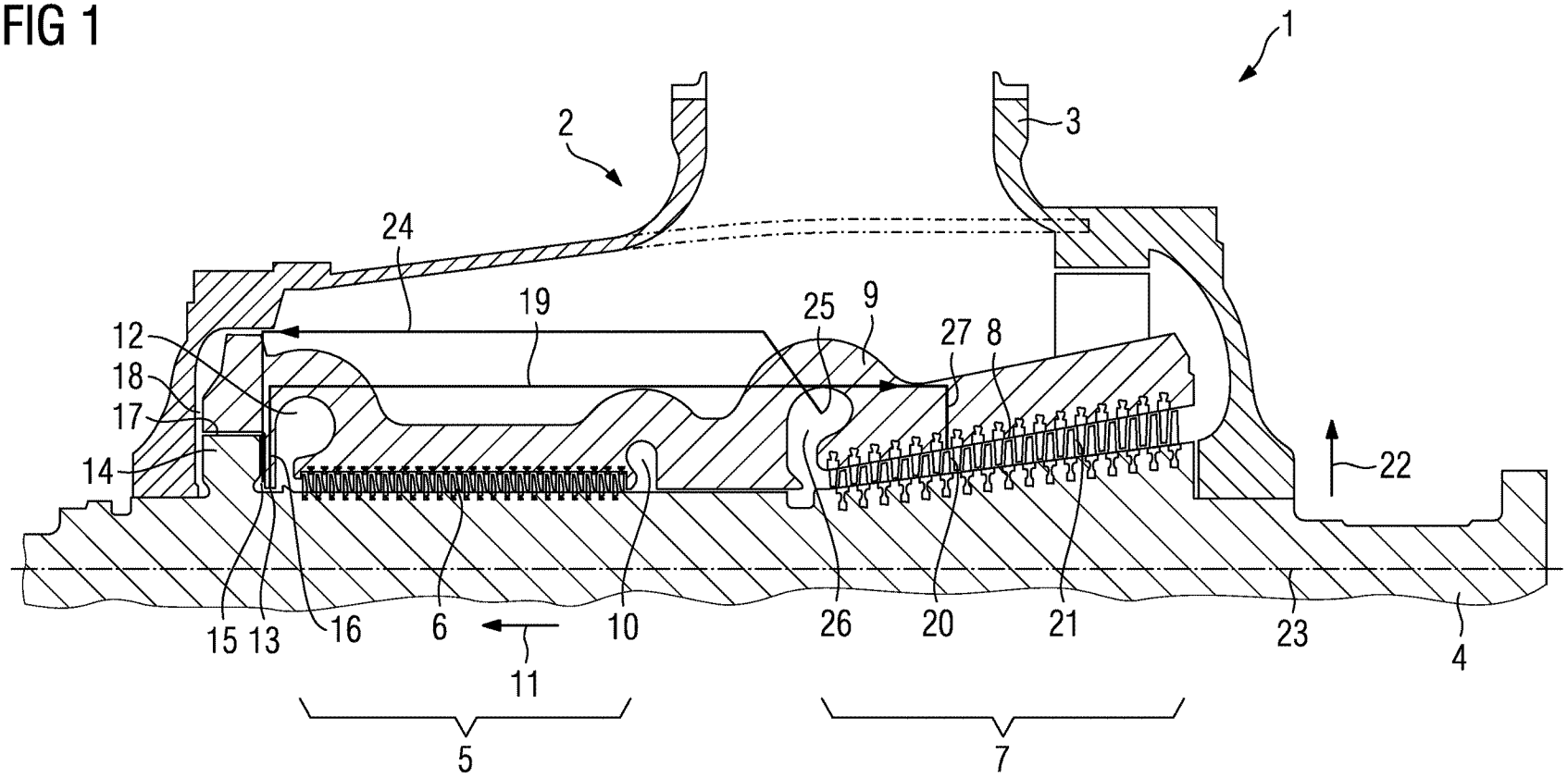
FIG. 1 shows a cross section through a steam turbine according to the invention.

FIG. 1 shows a cross section through a steam turbine 1. The steam turbine 1 comprises a combined high-pressure and medium-pressure turbine section 2. The significant feature of the steam turbine 1 is that a common outer casing 3 is arranged around the high-pressure and medium-pressure turbine section 2. The steam turbine 1 comprises a rotor 4, on which there is a first blading region 5, which is arranged in a high-pressure flow duct 6. The rotor 5 furthermore comprises a second blading region 7, which is arranged in a medium-pressure flow duct 8. Both the high-pressure flow duct 6 and the medium-pressure flow duct 8 comprise a plurality of rotor blades (not provided with a reference sign), which are arranged on the rotor 4, and a plurality of guide blades (not provided with a reference sign), which are arranged in an inner casing 9. The terms "high-pressure turbine section" and "medium-pressure turbine section" refer to the steam parameters of the inflowing steam. Thus, the pressure of the steam flowing into the high-pressure turbine section is higher than the pressure of the steam flowing into the medium-pressure turbine section. The terms "high-pressure turbine section" and "medium-pressure turbine section" also differ in the feature that the steam flowing out of the high-pressure turbine section is reheated in an intermediate superheater and then flows into the medium-pressure turbine section.

There is no standard definition of high-pressure and medium-pressure turbine sections which is used by those skilled in the art.

The steam turbine 1 illustrated in FIG. 1 is distinguished by a common inner casing 9 for the first blading region 5 and the second blading region 7. During operation, a steam flows into a high-pressure inflow zone 10. From there, the steam flows through the first blading region 5 in a first direction of flow 11. After flowing through the first blading region 5, the steam flows into a high-pressure outflow region 12 and out of the steam turbine. The steam in the high-pressure outflow zone 12 has temperature and pressure values which differ from the temperature and pressure values of the steam in the high-pressure inflow zone 10. In particular, the temperature and pressure values have fallen due to expansion of the steam. The steam in the high-pressure outflow zone 12 has temperature and pressure values such that this steam can be referred to as wet steam. This means that said steam contains extremely small condensed water particles. These extremely small water particles in the wet steam lead to erosion and corrosion damage in the case of impact on a component of the steam turbine 1 at high velocities. The majority of the wet steam flows out of the steam turbine 1 via the high-pressure outflow zone 12. However, a residual leakage flow remains in a gap space 13 between the rotor 4 and the inner casing 9. This wet steam in the gap space 13 flows in the first direction of flow 11 and impinges upon a dummy piston 14. The dummy piston 14 has a dummy piston prechamber 15, in which a superheated steam flows in. This superheated steam is in the dummy piston prechamber 15 arranged between the dummy piston 14 and a rear wall 16 of the inner casing 9. The superheated steam in the dummy piston prechamber 15 leads to an axial force acting on the dummy piston 14 and hence on the rotor 4.

There is a gap 17 between the inner casing 9 and the rotor 4 in the region of the dummy piston 14. A steam can flow through this gap, entering an intermediate space 18 situated between the outer casing 3 and the inner casing 9. A wet steam in the gap 17 could lead to an increased risk of corrosion and erosion of the outer casing 3.

According to the invention, a wet steam line 19 is now arranged in the steam turbine 1, establishing a fluidic connection between the gap space 13 and a first pressure space 20, wherein the gap space 13 is arranged between the rotor 4 and the inner casing 9. The first pressure space 20 is situated in the second blading region 7, in particular in a second flow duct 21. The illustrative embodiment shown in FIG. 1 shows that the first pressure space 20 is arranged in the region of the second flow duct 21. The pressure in this first pressure space 20 should likewise be such that the pressure for the wet steam in the gap space 13 is higher than in the first pressure space 20, with the result that a pressure gradient prevails in the wet steam line 19, leading to the wet steam passing from the gap space 13 to the first pressure space 20.

The dummy piston 14 extends in a radial direction 22 which is substantially perpendicular to the axis of rotation 23.

The dummy piston steam line 24 is connected fluidically to a steam source 25. As illustrated in FIG. 1, the inflow zone 26 forms the steam source 25. This steam, which flows in the inflow zone 26 into the medium-pressure turbine section, is a superheated steam, which enters the dummy piston prechamber 15. In an alternative embodiment, the steam source 25 can also be arranged outside the steam turbine 1.

The inner casing 9 has a feed opening 27, to which the wet steam line 19 can be connected.

Figure 2:
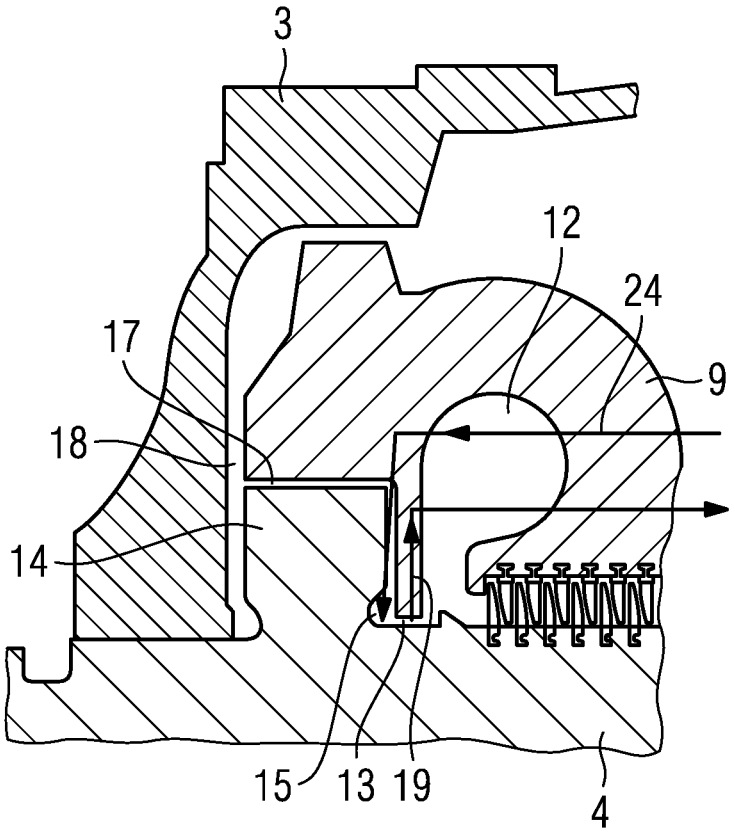
FIG. 2 shows an enlarged detail in the region of the dummy piston of the steam turbine in FIG. 1.

FIG. 2 shows an enlarged detail of the high-pressure outflow zone 12 of the high-pressure turbine section. The inner casing 9 is designed in such a way that a high-pressure outflow zone 12 is surrounded and lies opposite the rotor 4 in the region of the gap space 13. The gap space 13 should be as small as possible to ensure that the wet steam in the high-pressure outflow zone 12 does not flow out via the gap space 13. The majority of the wet steam will pass via the high-pressure outflow zone 12 to an intermediate superheater. A smaller part passes as a leakage flow between the rotor 4 and the inner casing 9 and into the gap space 13. A cavity (not shown specifically), which is connected to the gap space 13, is therefore arranged in the inner casing 9. Via this cavity and via the wet steam line 19, the leakage flow is as it were extracted. The first pressure space 20 is used to drive this extraction, having a lower pressure than the pressure in the gap space 13. Further flow of the leakage flow formed by wet steam in the gap space 13 in the direction of the dummy piston prechamber 15 is prevented by the fact that the majority of the wet steam is extracted in the wet steam line 19. The superheated steam which enters the dummy piston prechamber 15 via a dummy piston line 24 will likewise propagate in two directions. First of all, the superheated steam will propagate in the direction of the gap 17 and finally impinge upon the outer casing 3. Another part of the superheated steam flows in the direction of the gap space 13 and, like the wet steam, is extracted via the wet steam line 19 toward the first pressure space 20.

The invention claimed is:

1. A steam turbine, comprising:

a rotatably mounted rotor on which there is a first blading region and a second blading region, each blading region comprising a plurality of rotor blades, wherein the first blading region is arranged in a high pressure flow duct and the second blading region is arranged in a second flow duct;

an inner casing arranged around the rotor;

wherein the high-pressure flow duct is arranged between the rotor and the inner casing;

wherein the rotor comprises a dummy piston prechamber and a dummy piston, wherein the steam turbine has a dummy piston line directly connected to a source of superheated steam, wherein the dummy piston line opens into the dummy piston prechamber such that superheated steam flows into the dummy piston prechamber and substantially fills the dummy piston prechamber with superheated steam, wherein the steam turbine has a wet steam line, which establishes a direct fluidic connection between a gap space arranged between the rotor and inner casing and a first pressure space disposed in the second blading region, wherein a pressure in the gap space is higher than in the first pressure space such that wet steam flows from the gap space to the first pressure space, thereby substantially preventing flow of wet steam into the dummy piston prechamber, and wherein the gap space is further arranged between the dummy piston prechamber and a high-pressure outflow zone of the high-pressure flow duct; and wherein the first pressure space is disposed between adjacent rotor blades in the second blading region.

2. The steam turbine as claimed in claim 1, wherein the dummy piston is designed to compensate for rotor thrust which occurs during operation.

3. The steam turbine as claimed in claim 1 wherein the dummy piston extends in a radial direction.

4. The steam turbine as claimed in claim 3, wherein the dummy piston prechamber is formed between the dummy piston and the inner casing.

5. The steam turbine as claimed in claim 1, wherein the steam source is arranged outside the steam turbine.

6. The steam turbine as claimed in claim 1, wherein the second flow duct has the first pressure space and a feed opening for feeding steam into the first pressure space.

7. The steam turbine as claimed in claim 6, wherein the second flow duct has a plurality of blade stages arranged in series in a direction of flow and comprises guide and rotor blades, and wherein the first pressure space is arranged downstream of one blade stage of the plurality of blade stages.

8. The steam turbine as claimed in claim 1, wherein the inner casing has a cavity which opens toward the gap space.

9. The steam turbine as claimed in claim 1, wherein the high-pressure flow duct and the second flow duct are arranged in the common inner casing.

* * * * *